US007496322B2

(12) United States Patent
Stahuber et al.

(10) Patent No.: US 7,496,322 B2
(45) Date of Patent: Feb. 24, 2009

(54) DEVICE AND METHOD FOR CHARGING A MEDIA TRANSPORT BELT CONVEYOR IN A PRINTER OR COPIER

(75) Inventors: Markus Stahuber, Miesbach (DE); Albert Eben, Oberpframmern (DE); Joseph Knott, Tutzing (DE)

(73) Assignee: Oce Printing Systems GmbH, Poing (DE)

( * ) Notice: Subject to any disclaimer, the term of this patent is extended or adjusted under 35 U.S.C. 154(b) by 312 days.

(21) Appl. No.: 10/535,543

(22) PCT Filed: Oct. 16, 2003

(86) PCT No.: PCT/EP03/11487

§ 371 (c)(1),
(2), (4) Date: Oct. 23, 2006

(87) PCT Pub. No.: WO2004/046830

PCT Pub. Date: Jun. 3, 2004

(65) Prior Publication Data

US 2007/0041755 A1 Feb. 22, 2007

(30) Foreign Application Priority Data

Nov. 18, 2002 (DE) ..... 102 53 698

(51) Int. Cl.
*G03G 15/01* (2006.01)
*G03G 15/20* (2006.01)

(52) U.S. Cl. ..... 399/303; 399/312; 399/313

(58) Field of Classification Search ..... 399/302, 399/303, 310, 312, 313
See application file for complete search history.

(56) References Cited

U.S. PATENT DOCUMENTS 5,159,392 A 10/1992 Kasahara et al.
5,353,101 A 10/1994 Adachi et al.
5,666,622 A 9/1997 Harasawa et al.
6,496,673 B2 * 12/2002 Bessho ..... 399/175
7,386,263 B2 * 6/2008 Stahuber ..... 399/313
2002/0006295 A1 1/2002 Kitahara

FOREIGN PATENT DOCUMENTS

DE 195 01 544 A1 7/1995
DE 195 48 916 A1 7/1996
DE 102 47 368 B4 4/2004
JP 11161058 A 6/1999

(Continued)

*Primary Examiner*—Hoang Ngo
(74) *Attorney, Agent, or Firm*—Schiff Hardin LLP

(57) ABSTRACT

A device and a method are provided for recharging a belt conveyor which is used for transporting a printing medium in the transfer area of an electrophotographic printer or a copying machine. The device includes a blade-like contacting element which is adjacent to the belt conveyor and arranged transversally with respect to the forward motion thereof. The contacting element makes it possible to transfer an electric charge to the belt conveyor and is mounted on a bearing element which can be inserted into a printer or a copying machine and withdrawn therefrom. A method is provided for controlling a printer or copier device by which errors, such as paper jams, can be cleared automatically. A controller commands a module having the error to clear the error automatically. The commands are sent to modules beginning at the output of the printer or copier device and moving in a reverse direction to the paper flow direction of the printer or copier so as to automatically clear errors such as paper jams. Status signals indicating whether the error has successfully been cleared are reported back to the controller. A printer or copier for carrying out the method and a computer program for carrying out the method are also disclosed.

31 Claims, 5 Drawing Sheets

FOREIGN PATENT DOCUMENTS

| | | | |
|---|---|---|---|
| JP | 11219049 | A | 8/1999 |
| JP | 2000-321890 | A | 11/2000 |
| JP | 2000321890 | A | 11/2000 |
| JP | 2001175095 | A | 6/2001 |

* cited by examiner

DEVICE AND METHOD FOR CHARGING A MEDIA TRANSPORT BELT CONVEYOR IN A PRINTER OR COPIER

BACKGROUND OF THE INVENTION

1. Field of the Invention

The present invention concerns a device and a method for electrical charging of a transport belt for transporting recording media in a transfer printing region of an electrophotographic printer or copier device. The invention also concerns an associated blade-like contact element.

2. Description of the Related Art

In electrophotographic printers or copier devices, the transfer of a toner image from an the intermediate carrier (for example a photoconductor drum or a photoconductor belt) onto a the recording medium is referred to as transfer printing. The section of the printer or copier device at which the intermediate carrier and the recording medium are brought into contact with one another is referred to as a transfer printing region. In the transfer printing region, the intermediate carrier (for example the generated surface of a photoconductor drum) and the recording medium move with the same speed in the same direction while the toner is transferred from the intermediate carrier onto the recording medium.

A good print image on the recording medium can only be achieved when a uniform contact is produced between the recording medium and the intermediate carrier in the transfer printing region. A good and uniform contact between the recording medium and the intermediate carrier can be achieved with the aid of an electrostatically-chargeable transport belt on which the recording media lies and, adhering to this with electrostatic forces, is transported through the transfer printing region.

A device for transfer of a toner image with the aid of an electrostatically-chargeable transport belt is shown in German Patent Document DE 102 47 368.4 (not previously published), which is incorporated by reference into the present specification. In this device, the transport belt is charged with a charge whose polarity is different than the polarity of the charge of the toner image. This electrostatic charging of the transport belt has a two-fold function: on the one hand, it effects an electrostatic attraction of the recording medium to the transport belt and thus a secure guidance of the recording medium in the transfer printing region; on the other hand, it effects the transfer of the toner image from the intermediate carrier onto the recording medium.

Similar devices with electrostatically-charge transport belts are also known from U.S. Pat. No. 5,666,622, German Patent Document DE 195 01 544 A1 and U.S. Pat. No. 5,159,392. In these three documents, the transport belt is either charged via corona arrangements (what are known as corotrons) or via contact rollers. A corotron typically comprises one or more thin, gold-coated tungsten wires whose electrical potential is about 1000 V relative to a grounded housing, such that the air surrounding the wires is ionized.

However, corotrons have a number of serious disadvantages including, for example, the ozone formation due to the high charge voltage and the relatively complicated exchange of worn-our corotron wires. Moreover, the corotron wires are easily contaminated with dust, belt abrasion particles and toner particles, which leads to an irregular charge distribution on the transport belt. Locations with a lower transport belt charge lead to a less complete transfer of the toner onto the overlying the recording medium and thus to unwanted lightening, or fading, of the print image. The cleaning of the corotron wires is not only elaborate but also subjects the wires to a significant mechanical stress and shortens their lifespan.

Contact rollers also have a disadvantage in that they can become contaminated easily and thereby lead to an irregular charging of the transport belt. Moreover, they can not be directly arranged in the transfer printing region because they would interfere with the uniform arrangement of the recording medium on the intermediate carrier. Nevertheless, in order to achieve a sufficient charge of the transport belt in the transfer printing region, a certain current must flow at the contact point from the contact roller and transport belt to the transfer printing region. Therefore, the conductivity of the transport belt may not be too low, which represents a disadvantageous limitation for the selection of the transport belt material used.

SUMMARY OF THE INVENTION

The present invention provides a device and a method for charging a transport belt in a printer that enables a uniform charge of the transport belt in the transfer printing region and requires less maintenance expenditure.

This is inventively achieved via a device and a method in which a blade-like contact element is arranged transverse to the running direction of the transport belt and abutting on the belt. The contact element transfers an electrical charge to the transport belt. The blade-like contact element can be arranged on a carrier element that can be inserted into and extracted from the printer or copier.

Such a blade-like contact element can be arranged directly in the transfer printing region on the side of the transport belt facing away from the intermediate carrier, and therewith provides a reliable, uniform electrostatic charge of the transport belt in the transfer printing region. Since the transport belt continually drags against the blade-like contact element, the contact element is constantly cleaned. Due to the ability of the carrier element to be removed, the blade-like contact element is easily replaced during maintenance. The blade-like contact element is preferably fastened on the carrier element so that it can be detached, such that it can be easily exchanged as an expendable part.

For better understanding of the present invention, reference is made in the following to the preferred exemplary embodiment shown in the drawings which is described using specific terminology. However, it is noted that the protective scope of the invention should not thereby be limited since such variations and further modifications to the shown device and the method as well as such further applications of the invention as they are shown therein are viewed as typical present or future specialized knowledge of a competent average man skilled in the art.

DETAILED DESCRIPTION OF THE PREFERRED EMBODIMENTS

Figure 1:
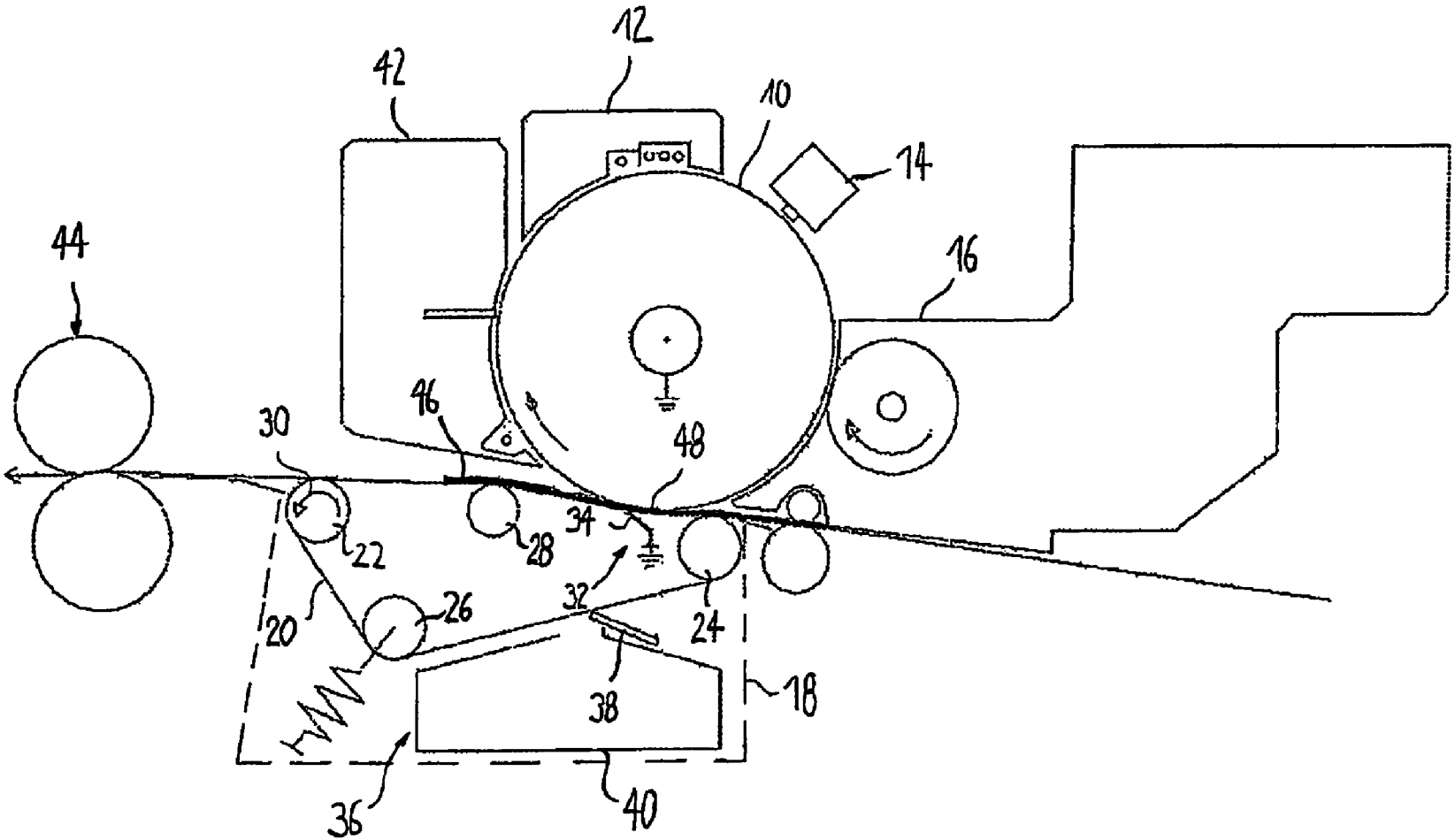
FIG. 1 is a schematic representation of the components of an electrophotographic printer or copier that are utilized in the image generation.

The components of an electrophotographic printer that participate in the printed image generation are schematically shown in FIG. 1. FIG. 1 shows a photoconductor drum 10 whose peripheral surface is coated with a photosemiconductor, for example arsenic triselenide ($As_2Se_3$). Also shown in FIG. 1 are charge corotron 12 for charging of the photosemiconductor layer of the photoconductor drum 10, a character generator 14 for exposure of the photosemiconductor layer in order to generate a latent charge image on the photosemiconductor layer, and a developing unit 16 to develop the latent charge image with charged toner particles.

A paper transport aggregate 18 is also schematically shown in FIG. 1 by a dashed box. The paper transport aggregate 18 comprises a transport belt 20 that is directed around a first roller 22, a second roller 24, a tension roller 26 and a positioning roller 28. The transport belt 20 is driven by the first roller 22 in the direction characterized by the arrow 30. The paper transport aggregate 18 also comprises a device 32 for electrical charging of the transport belt 20 that is only schematically shown in FIG. 1. The device 32 comprises a blade-like contact element 34 that is arranged transverse to the running direction of the transport belt 20 and abutting on this. Finally, the paper transport aggregate 18 comprises a cleaning unit 36 with an abrasion ridge 28 for abrasion of toner particles from the transport belt 20 and a toner capture reservoir 40 for capture of the abraded toner.

Finally, a cleaning unit 42 for cleaning of the photoconductor drum and a fixing unit 44 for fixing the toner image onto the paper are shown in FIG. 1. More detailed explanations of the function of the listed elements from FIG. 1 are found in German Patent Document DE 102 47 368.4 (cited above, not previously published) and have not been repeated here.

The transport belt 20 serves for the transport of a paper sheet 46 (likewise shown in FIG. 1) through the transfer printing region 48 in which the paper sheet 46 is pressed against the photoconductor drum 10. The transport belt 20 is charged by the device 32 with a charge that is opposite the charge of the toner particles. The electrostatic charge of the transport belt 20 provides for a secure retention of the sheet 46 on the transport belt and for transfer of the toner particles from the photoconductor drum 10 onto the sheet 46.

As is to be learned from the schematic representation of FIG. 1, in the transfer printing region the blade-like contact wavelength 34 of the transport belt 20 contacts on the side facing away from the photoconductor drum 10 (the underside in the representation of FIG. 1). This means that the electrical charge there is precisely transferred to the transport belt 20 at which it is required. Upon transfer of the toner from the photoconductor drum 10 onto the sheet 46, an electrical current flows from the transport belt 20 to the photoconductor drum 10. Since the contact blade 34 is arranged in the transfer printing region, this current does not have to flow in the longitudinal direction of the transport belt 20 to the transfer printing region 48.

Figure 2:
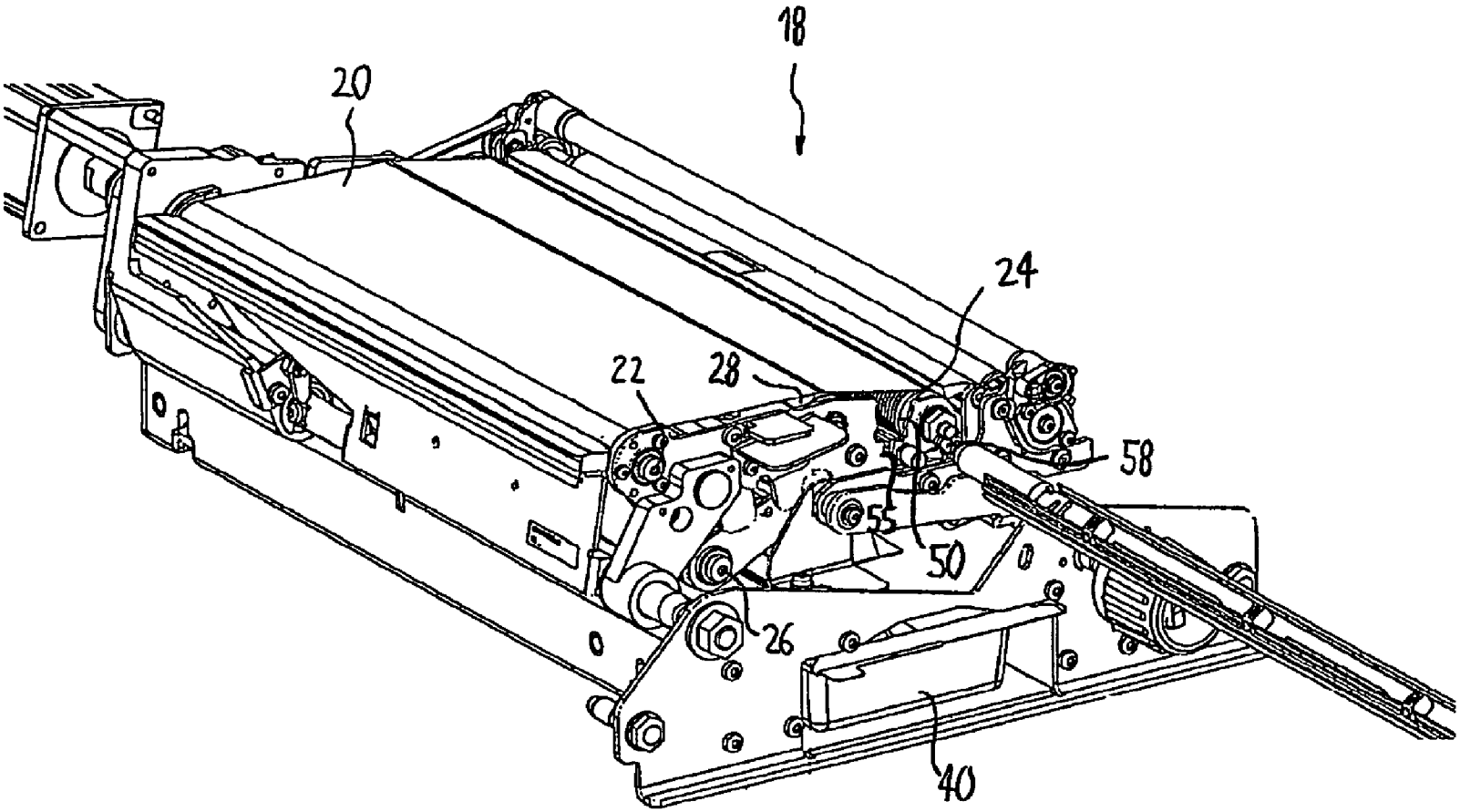
FIG. 2 is a perspective view of a paper transport aggregate for a printer or copier in which the carrier element for the blade-like carrier element is extracted.

The paper transport aggregate 18, which was shown only schematically in FIG. 1, is shown in a perspective representation in FIG. 2. One recognizes the transport belt 20, the first roller 22 (or, respectively, its axle), the second roller 24, the tension roller 26 (or, respectively, its axle), the positioning roller 28 and the toner capture reservoir 40 described in connection with FIG. 1. The device 32 for electrical charging of the transport belt 20 is also shown. The device 32 comprises a carrier element 48 made of plastic, to which carrier element 48 the blade-like contact element 34 is attached.

The paper transport aggregate 18 has a recess 50 into which the carrier element 48, with its attached contact element 34, can be inserted. The paper transport aggregate 18 with inserted carrier elements 48 is shown in FIG. 3.

Figure 3:
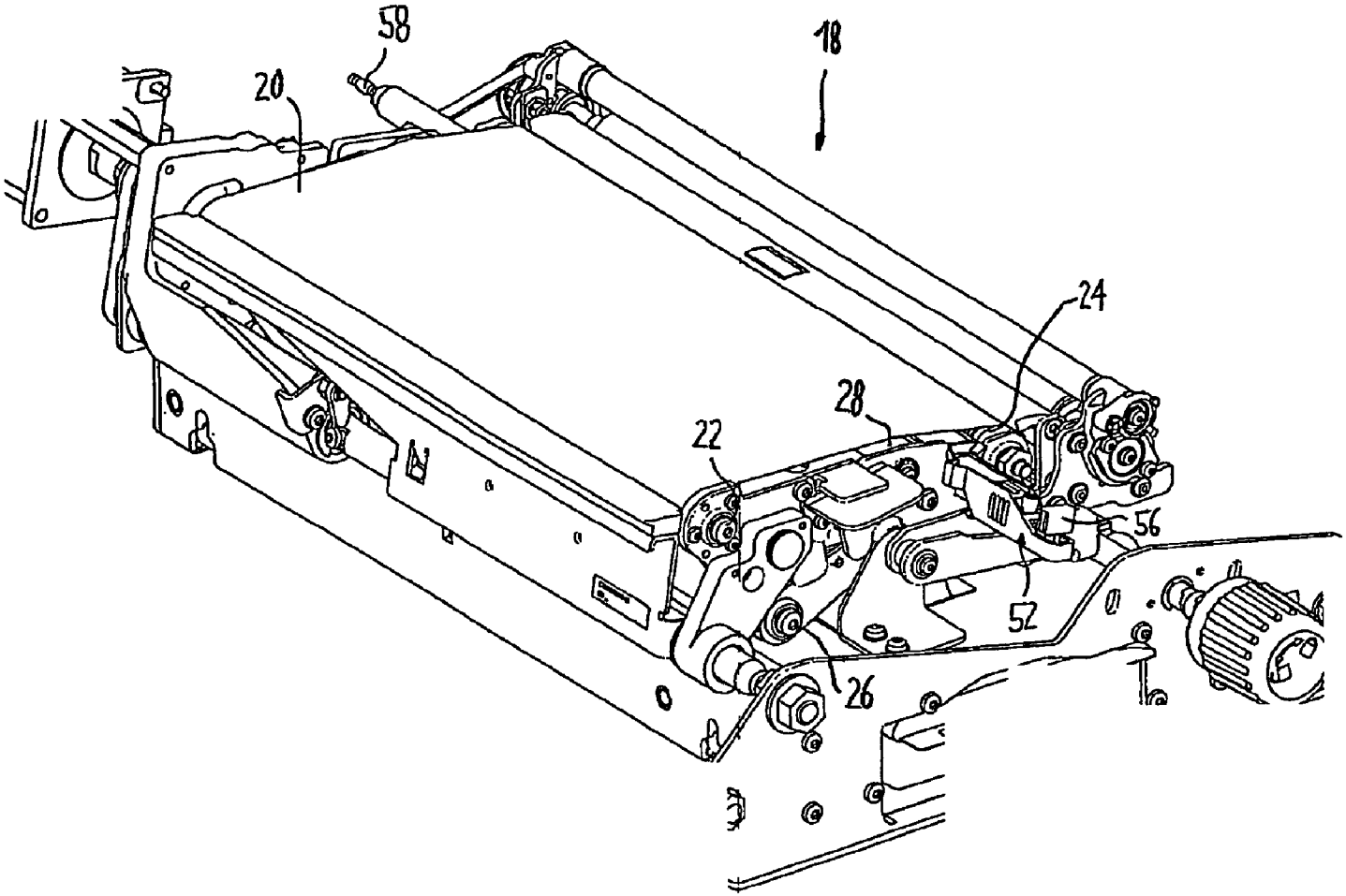
FIG. 3 is a perspective view of the paper transport aggregate from FIG. 2, in which the carrier element is inserted.

As is to be learned from FIGS. 2 and 3, the carrier element 48 has an engagement section 52 at which it can be gripped upon insertion into or, respectively, upon extraction from the paper transport aggregate 18. A detent hook 54 (see FIG. 2) is integrated into the engagement section 52, which detent hook 54 is pre-stressed in a blocking position in which it engages in a matching groove 55 in the recess 50 when the carrier element 48 is completely inserted into the paper transport aggregate 18. The detent hook 54 can be raised from its blocking position via activation of a release button counter to the prestress such that the carrier elements 48 can be extracted from the paper transport aggregate 18.

A first plug element 58 (see FIG. 2 and FIG. 3) is located on the end of the carrier element 48 opposite the engagement section 52. A second plug element (not shown) is located in the printer, with which second plug element the first plug element forms an electrical plug connection when the carrier element 48 is completely inserted into the paper transport aggregate 18 (and this is, for its part, inserted into the printer).

Figure 4:
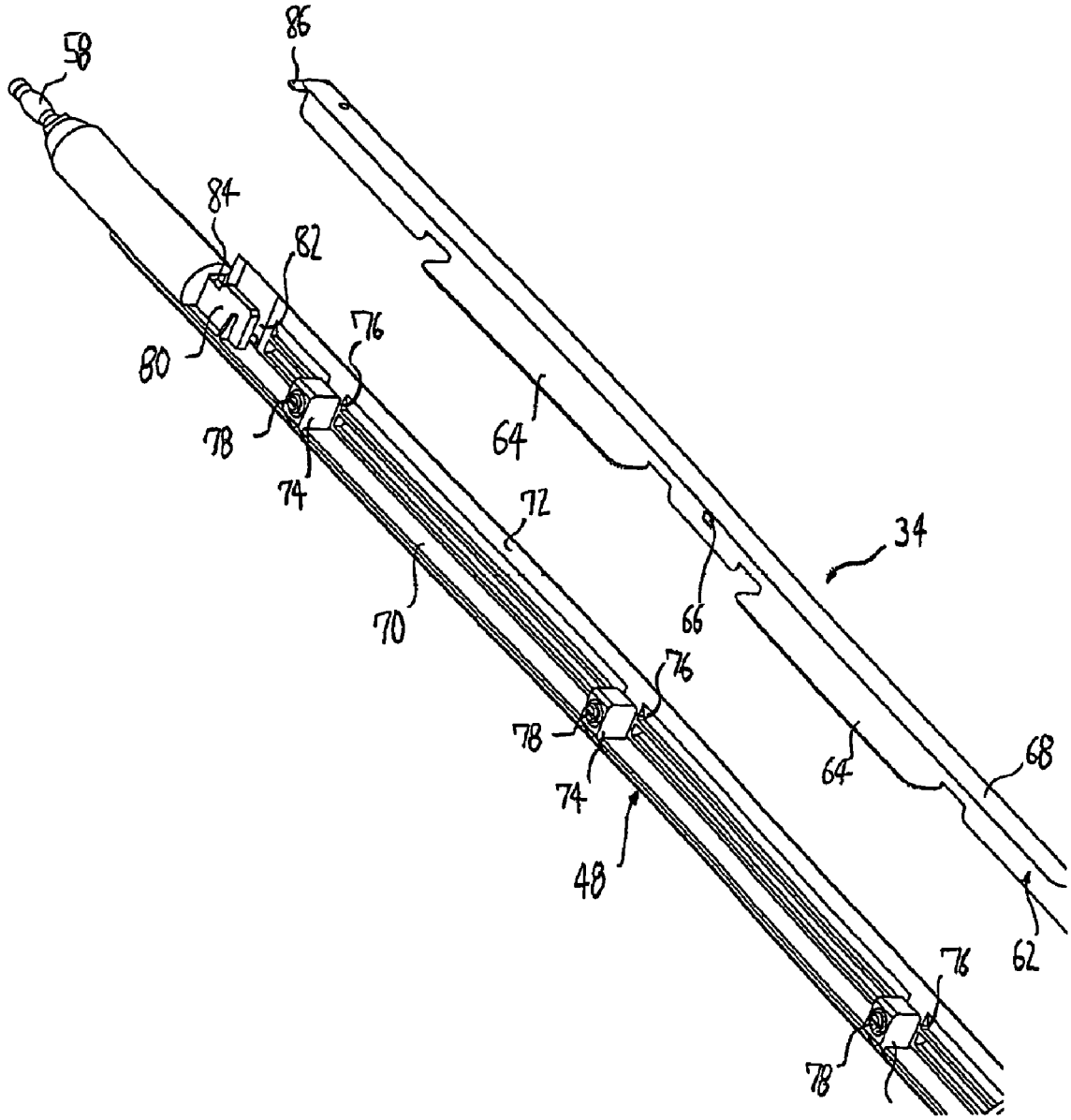
FIG. 4 is a perspective view of the carrier element and of the blade-like contact element.

The carrier element 48 and the blade-like contact element 34 are shown in an unassembled state in FIG. 4. The blade-like contact element comprises an angle plate with a first section 60 and a second section 62 that, in the shown exemplary embodiment, form with one another an angle of approximately 90°. The second section 62 of the blade-like contact element 34 has two recurved sections 64. A rectangular gap 66 in the second section 62 is located between the recurved sections 64.

A film 68 made from polyimide is adhered with a conductive adhesive onto the first section 60 of the angle plate. The film 68 has a thickness of 75 μm. Via interspersed carbon black particles, its volume resistance is reduced to a value that is between $10^2$ and 109 Ωcm, preferably between 106 and 108 Ωcm. Its surface resistance is between $10^2$ and 1012 Ω/sq, preferably between 1010 and 1012 Ω/sq.

Figure 5:
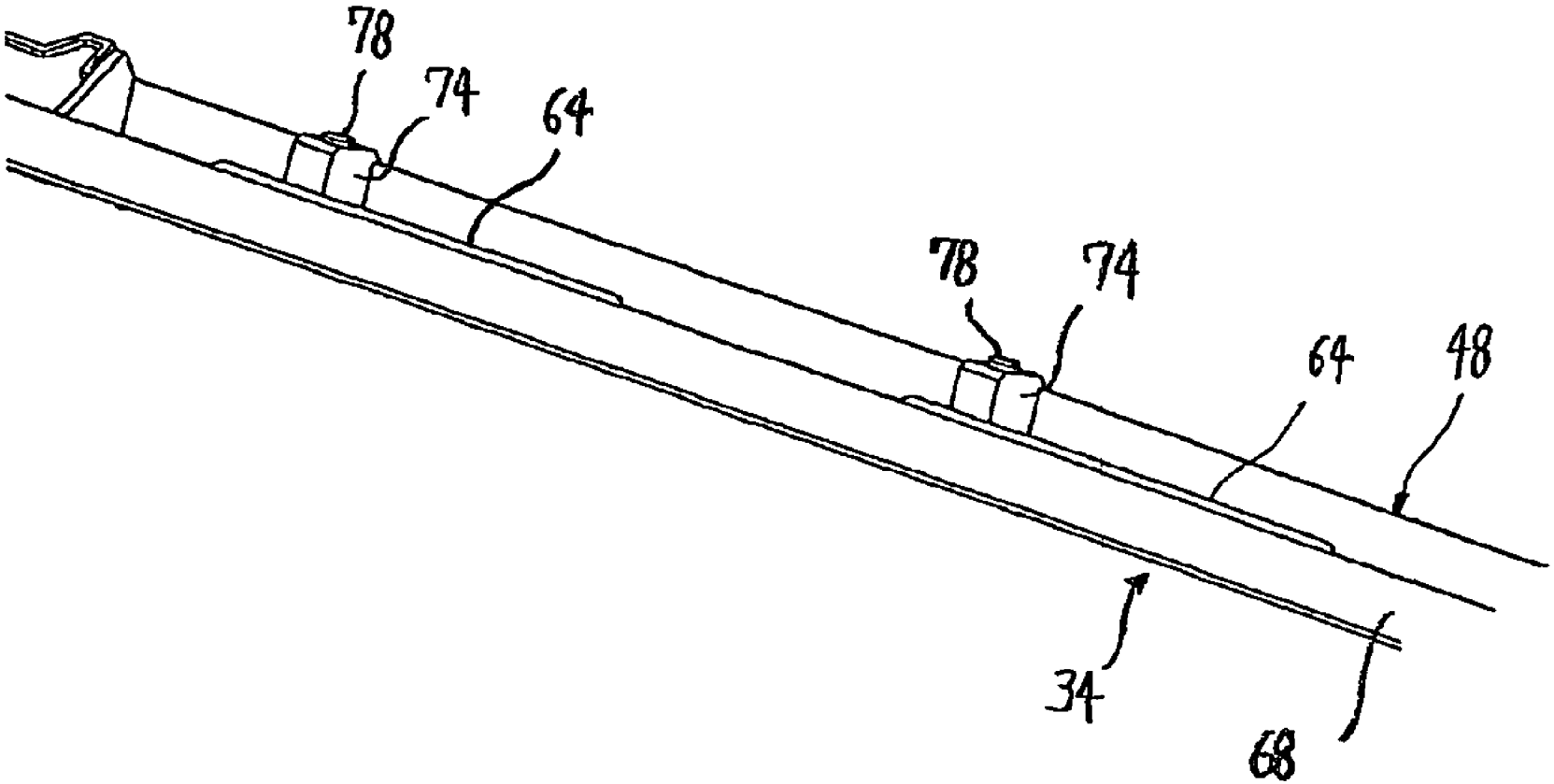
FIG. 5 is a perspective view of the carrier element and of the blade-like contact element from FIG. 4 from another viewing direction.

The carrier element 48 has an essentially V-shaped cross section that is formed from a floor area 70 and a back wall 72. Small blocks 74 are arranged on the floor area 70 that are separated from the back wall 72 and with this respectively form a groove 76. Such a groove 76 can be recognized particularly well in FIG. 5, in which the carrier element 48 and the blade-like contact element 34 are shown from a different viewing angle. Pressure pins 78 that are pre-stressed against the back wall 72 are spring-borne in the small blocks 74. Finally, a web 80 that, together with the back wall 72, forms a further groove 82 is arranged on the floor area 70.

The groove 82 and the three grooves 76 form a recess into which the second section 62 of the blade-like contact element 34 can be inserted with positive fit. Both outer pressure pins 78 thereby press on the second section 62 of the blade-like contact element 34 and hold this in position. The center pressure pin 78 has a rounded tip and engages in the gap 66 in the second section 62 of the blade-like contact element 34, whereby it exerts pressure on the lower edge of the gap 66 in the representation of FIG. 4 and thereby exerts a force component on the blade-like contact element 34 that pushes this into the recess.

A notch 84 is located in the web 80, into which notch 84 a guide section 86 on the blade-like contact element 34 engages when it is inserted into the recess of the carrier element 48. The guide section 86 and the notch 84 thereby help to find the correct position upon insertion of the blade-like contact element 34 into the recess of the carrier element 48.

Upon insertion of the blade-like contact element 34 into or, respectively, upon extraction of the same from the recess of the carrier element 48, the blade-like contact element can be gripped at the recurved sections 64. The blade-like contact element 34 is an expendable part and can be easily exchanged in the manner specified here and without the assistance of tool [sic]. In particular the exchange of the blade-like contact element is made easier in that the carrier element can simply be extracted from and inserted back into the printer or copier (in the shown exemplary embodiment from the paper transport aggregate 18 of such a one).

Electrical contacts (not shown) that contact the second section 62 of the angle plate when this is inserted into the recess of the carrier plate 48 are located in the groove 82. A current flow from the plug element 58 over the angle plate and the film 68 onto the transport belt is ensured via these contacts.

Although a preferred exemplary embodiment is shown and described in detail in the drawings and in the preceding specification, this should be viewed as purely exemplary and not as limiting the invention. It is noted that only the preferred exemplary embodiment is shown and described, and all variations and further modifications that presently and in the future lie within the protective scope of the invention should be protected.

Although other modifications and changes may be suggested by those skilled in the art, it is the intention of the inventors to embody within the patent warranted hereon all changes and modifications as reasonably and properly come within the scope of their contribution to the art.

The invention claimed is:

1. A device for electrical charging of a transport belt for transporting the recording media in a transfer printing region of an electrophotographic printer or copier, comprising:

a blade-like contact element via which electrical charge is transferred to the transport belt, said blade-like contact element being arranged transverse to a running direction of the transport belt and abutting on the transport belt; and a carrier element on which said blade-like contact element is mounted, said carrier element being insertable into the printer or copier and extractable from the printer or copier.

2. A device according to claim 1, further comprising:

a catch constructed to secure said carrier element in place when said carrier element is completely inserted into the printer or copier.

3. A device according to claim 1, further comprising:

a first plug element arranged on one of said carrier elements and said blade-like contact element, a second plug element arranged in the printer or copier, and said first plug element and said second plug element form with one another an electrical plug connection when said carrier element is completely inserted into the printer or copier.

4. A device according to claim 1, wherein said carrier element defines a recess into which said blade-like contact element is insertable with a positive fit.

5. A device according to claim 4, wherein said recess includes at least one groove.

6. A device according to claim 4, wherein said blade-like contact element is retained in the recess by at least one spring-borne pressure pin that is pre-stressed against the blade-like contact element.

7. A device according to claim 6, wherein said blade-like contact element has a gap in which said pressure pin engages when the blade-like contact element is inserted into the recess of the carrier element.

8. A device according to claim 1, wherein said blade-like contact element comprises a plastic film that provides an electrical contact with the transport band.

9. A device according to claim 8, wherein said plastic film is comprised of polyimide.

10. A device according to claim 8, wherein an electrical resistance of the plastic film is reduced by interspersed carbon black particles.

11. A device according to claim 8, wherein an electrical volume resistance of the plastic film is between $10^2$ and 109 Ωcm.

12. A device according to claims 8, wherein an electrical surface resistance of the plastic film is between $10^2$ and $10^{12}$ Ω/sq.

13. A device according to claims 8, wherein a thickness of said plastic film is between 50 μm and 100 μm.

14. A device according to claims 4, wherein said blade-like contact element includes an angle plate with a first section and a second section that together form an angle, and wherein said plastic film is attached on a first section and second section is at least partially inserted into the recess of the carrier element.

15. A device according to claim 14, wherein said second section has at least one recurved section at which said blade-like contact element is gripped at least one of upon insertion into and, respectively, upon removal from the recess of the carrier element.

16. A device according to claim 14, wherein said electrical contacts are arranged on the carrier element, said electrical contacts being in contact with the angle plate when said angle plate is inserted into said recess of said carrier element.

17. A blade-like contact element for charging a transport belt for transport of the recording media in a transfer printing region of an electrophotographic printer or copier device, comprising:

a first section on which a plastic film is attached, said first section being suitable to produce an electrical contact with the transport belt; and a second section for attachment of said blade-like contact element to a carrier element which is insertable into the printer or copier.

18. A blade-like contact element according to claim 17, wherein said plastic film is of polyimide.

19. A blade-like contact element according to claim 17, wherein said electrical resistance of the plastic film 68 is reduced via interspersed carbon black particles.

20. A blade-like contact element according to claim 17, wherein said volume resistance of the plastic film is between $10^2$ and 109 Ωcm, preferably between 106 and 108 Ωcm.

21. A blade-like contact element according to claim 17, wherein said electrical surface resistance of the plastic film is between $10^2$ and $10^{12}$ Ω/sq, preferably between $10^{10}$ and $10^{12}$ Ω/sq.

22. A blade-like contact element according to claim 17, wherein said thickness of the plastic film is between 50 μm and 100 μm.

23. A blade-like contact element according to claim 17, wherein said first section and a second section are sections of an angle plate that together form an angle.

24. A blade-like contact element according to claim 23, in which the second section has at least one recurved section at which the blade-like contact element can be gripped upon insertion into or, respectively, upon removal from the recess of the carrier element.

25. A blade-like contact element according to claims 17 that is fashioned for use with a transport belt for transporting the recording media in a transfer printing region of an electrophotographic printer or copier.

26. A method for electrostatic charging of a transport belt for the transport of the recording media in the transfer printing region of an electrophotographic printer or copier, comprising the steps of:

transferring an electrical charge to the transport belt via a blade-like contact element arranged transverse to a running direction of the transport belt and abutting on the transport belt; and mounting the blade-like contact element on a carrier element that is selectively insertable into and removable from the printer or copier.

27. A method according to claim 26, further comprising the steps of:

providing a first plug element arranged on the carrier element or on the blade-like contact element;

providing a second plug element arranged in the printer or copier; and forming an electrical plug connection by the first plug element and the second plug element when the carrier element is completely inserted into the printer or copier.

28. A method according to claim 26, wherein the carrier element has a recess into which the blade-like contact element can be inserted with a positive fit.

29. A method according to claim 26, wherein the recess comprises at least one groove.

30. A method according to claim 26, wherein the blade-like contact element is retained in the recess by at least one spring-borne pressure pin that is pre-stressed against the blade-like contact element.

31. A method according to claim 26, wherein the blade-like contact element comprises a plastic film made from polyimide that produces the electrical contact with the transport band.

* * * * *